US007559742B2

(12) United States Patent
Inoue et al.

(10) Patent No.: US 7,559,742 B2
(45) Date of Patent: Jul. 14, 2009

(54) INLET CASING AND SUCTION PASSAGE STRUCTURE

(75) Inventors: Yasuhiro Inoue, Kasumigaura (JP); Takashi Aki, Tsuchiura (JP); Seiji Kawabata, Tsuchiura (JP); Sadashi Tanaka, Kasumigaura (JP)

(73) Assignee: Hitachi Industries Co., Ltd., Tokyo (JP)

( * ) Notice: Subject to any disclaimer, the term of this patent is extended or adjusted under 35 U.S.C. 154(b) by 761 days.

(21) Appl. No.: 11/123,096

(22) Filed: May 6, 2005

(65) Prior Publication Data

US 2005/0254941 A1 Nov. 17, 2005

(30) Foreign Application Priority Data

May 6, 2004 (JP) ..... 2004-137513

(51) Int. Cl.
*F04D 29/44* (2006.01)

(52) U.S. Cl. ..... 415/184; 415/205; 415/208.2

(58) Field of Classification Search ..... 415/184, 415/191, 199.1, 199.3, 204, 212, 194–195, 415/205, 208.2, 120
See application file for complete search history.

(56) References Cited

U.S. PATENT DOCUMENTS

| | | | | |
|---|---|---|---|---|
| 15,384 | A * | 7/1856 | Munroe et al. | 415/184 |
| 23,207 | A * | 3/1859 | Wells et al. | 415/184 |
| 1,592,441 | A * | 7/1926 | Buehle | 415/184 |
| 1,646,405 | A * | 10/1927 | Innes | 415/184 |
| 1,650,475 | A * | 11/1927 | Trefz et al. | 415/184 |
| 3,289,596 | A * | 12/1966 | Springer | 415/204 |
| 3,313,518 | A * | 4/1967 | Nancarrow | 415/184 |
| 3,648,457 | A * | 3/1972 | Bobo | 60/737 |
| 3,667,221 | A * | 6/1972 | Taylor | 60/737 |
| 4,076,448 | A * | 2/1978 | Sanders, Jr. | 415/184 |
| 4,082,477 | A * | 4/1978 | Kronogard | 415/120 |
| 4,089,629 | A * | 5/1978 | Baumgartner et al. | 431/9 |
| 6,739,832 | B2 * | 5/2004 | Hansen et al. | 415/184 |
| 6,817,832 | B2 * | 11/2004 | Kim et al. | 415/204 |
| 2002/0192076 | A1 * | 12/2002 | Hansen et al. | 415/184 |
| 2003/0049122 | A1 * | 3/2003 | Kim et al. | 415/204 |
| 2003/0099544 | A1 * | 5/2003 | Brekke | 415/204 |

FOREIGN PATENT DOCUMENTS

| | | |
|---|---|---|
| JP | A-51-142101 | 12/1976 |
| JP | A-57-195899 | 12/1982 |
| JP | A-11-148498 | 6/1999 |

* cited by examiner

*Primary Examiner*—Richard Edgar
(74) *Attorney, Agent, or Firm*—Crowell & Moring LLP

(57) ABSTRACT

A prewhirl type inlet casing for inducing a spiral stream in fluid has a suction passage arranged on an upstream side, being orthogonal to a rotary shaft of fluid machinery, and an internal passage connected to the suction passage, the internal passage being formed in a spiral shape so as to induce a swirl stream orthogonal to the rotary shaft in the fluid. A guide vane provided in the fluid passage in the inlet casing has a rectifying function capable of distributing flow rates in the swirl stream of the fluid in the internal passage between the swirl center side and the swirl outer peripheral side, and causing the fluid to deflect into the swirling direction of the swirl stream induced by the internal passage.

6 Claims, 4 Drawing Sheets

INLET CASING AND SUCTION PASSAGE STRUCTURE

BACKGROUND OF THE INVENTION

The present invention relates to an inlet casing or a suction passage structure which is used for suction of fluid into fluid machinery for boosting up the pressure of fluid through the rotation of an impeller mounted on a rotary shaft, and also to a fluid machinery including a pump, a compressor, a blower or the like, using thereof. In a large-sized suction passage structure, an inlet casing produced as a coupling component for the fluid machinery and used for sucking fluid into a fluid machinery is in general connected to a suction passage which is a concrete construction or the like. The above-mentioned suction passage structure includes a non prewhirl type one in which fluid is led in a form of a suction stream into an inlet opening of fluid machinery, in parallel with a first reference line passing through the center line of a rotary shaft of the fluid machine and extending along the stream of fluid directed to the fluid machine in the suction passage, and a prewhirl type one in which a swirl flow is creased by a swirl portion incorporated in an inlet casing, being orthogonal to a rotary shaft of fluid machinery or which creates a swirl flow swirling around the rotary shaft or an extension or the rotary shaft.

Referring to FIG. 6 which shows a typical nonprewhirl type suction passage structure of a conventional configuration, the suction passage structure includes a suction passage 102 arranged orthogonal to a rotary shaft of fluid machinery on the upstream side as viewed in a stream toward the fluid machinery, and an internal passage 104 in a suction casing 103, which are arranged, being symmetric with each other to a first reference line C1 (which passes through the center line of a rotary shaft 101 while it also passes through a heightwise center position of the suction passage 102 or the internal passage 104, and which extends along a stream of fluid toward the fluid machinery in the suction passage 102 and the internal passage 104, a second reference line C2 being orthogonal to the first reference line C1). That is, the suction passage 102 and the internal passage 104 are arranged so that their center lines are substantially superposed on the first reference line C1. Thus, the fluid flowing in parallel with the reference line C1 in the suction passage 102 still flows in parallel with the first reference line C1 in the internal passage 104 even after passing through an inlet opening 105 of the inlet casing 103 which is a connection between the suction passage 102 and the inlet casing 103, and comes to a suction opening through which the fluid is sucked into an impeller 106 mounted on the rotary shaft 101.

Thus, the fluid led into the suction passage structure of the nonprewhirl type flows into the suction opening of the impeller on both sides of the reference line C1 while it interferes with a baffle portion 107 incorporating the most downstream part of the internal passage 104, and accordingly, there would be presented a zone where an inflow angle of the fluid at the inlet opening of the impeller and the angle of the inlet opening thereof are different from each other. As a result, there have been raised such disadvantages that a zone where cavitations are caused would be deviated, and further, serious vibration and noise would be possibly caused.

Referring to FIG. 7 which shows a conventional typical configuration of a prewhirl type, a suction passage structure of this type, includes a swirl part 113 which is provided in an internal passage 112 of an inlet casing 111, which is formed in a spiral shape and with which a swirl stream of fluid is induced, orthogonal to a rotary shaft 101. Thus, the fluid is sucked into a suction opening of an impeller 106, flowing in one way direction, while it interferes with a baffle portion 114 provided in the most upstream part of the swirl part 113.

The above-mentioned prewhirl type suction passage structure can avoid occurrence of the problem of deviation of a cavitations inducing zone which inherent to the conventional nonprewhirl type one. However, the prewhirl type suction passage structure has raised such a problem that the suction passage and the internal passage can hardly be formed, symmetric to each other with respect to the first reference line C1 as in the nonprewhirl type one. That is, as exhibited in an example shown in FIG. 8, should the suction passage 102 and the internal passage 116 of the inlet casing 115 be symmetric to each other, fluid guided through the suction passage 102 and the internal passage 116 would flow into the suction opening of the impeller 106 without being subjected to any resistance, and accordingly, it would induce both stream A which is steeply curved in a direction along the rotary shaft 101 and stream B which crosses the rotary shaft 101. The stream A is likely to peel off at the suction opening 117 of the impeller 106 while the stream B causes a wake at the rear surface part of the rotary shaft 101 so that a secondary stream occurs, resulting in deterioration of uniformity of the stream at the suction opening 117.

Thus, the conventional prewhirl type suction passage structure in general has in general such a structure, as shown in FIG. 7, that the suction passage 102 and the internal passage 112 are formed so as to be asymmetric with each other with respect to the first reference line C1, that is, they are eccentric with each other, in order to obtain uniformity of a stream at the suction opening of the impeller 106. In such an asymmetric configuration, it is required to provide a connection 106 between the suction passage 102 and the internal passage 112 in relatively upstream side part, resulting in occurrence of such a problem that the inlet casing 111 inevitably has a large size. Further, the spiral shape of the swirl part 113 of the internal passage 112 has to have a complicated curve. As a result, there has been raised such a problem that the design and fabrication thereof becomes complicated, resulting in an increase the costs thereof.

Further, in the prewhirl type suction passage structure, in order to constrain occurrence of both stream A and stream B shown in FIG. 8 so as to enhance the uniformity of the stream, there has been known such a configuration that an element which serves as a resistance against a stream of fluid in the internal passage 112 is provided in the downstream part of the internal passage 112. For example, as such an element, JP-A-51-142101 discloses a protrusion, and JP-A-11-148498 discloses a bevel shape bulge. However, it has not been sufficient with these elements to always main required uniformity of the stream, and accordingly, the suction passage and the internal passage are inevitably formed, symmetric to each other as in the example shown in FIG. 7.

The nonprewhirl type suction passage structure and the prewhirl type suction passage structure have been known as disclosed in JP-A-63-44960 in addition to the above-mentioned JP-A-51-142101 and JP-A-11-148498.

As stated above, there are used both nonprewhirl type suction passage structure and prewhirl type suction passage structure for fluid machinery. The nonprewhirl type suction passage structure may have the suction passage and the internal passage which are symmetric with each other, and accordingly, there may be offered such an advantage the shape of the internal passage can be simple so that it can be easily designed and fabricated but also offered such a disadvantage that a deviation of the cavitations inducing zone likely to occur. Meanwhile, the prewhirl type suction passage structure may avoid occurrence the problem of a deviation of the cavitations inducing zone, but the configuration of the internal passage becomes complicated so as to raise such a problem that the costs thereof is increased in view of its design and fabrication.

BRIEF SUMMARY OF THE INVENTION

The present invention is devised in view of the above-mentioned conventional problems, and accordingly, an object of the present invention is to provide a suction passage structure which can effectively avoid occurrence of a deviation of a cavitations inducing zone and as well can simplify the configuration of the internal passage, and to provide fluid machinery using such a suction passage structure.

To the end, according to the present invention, there is provided a suction passage structure provided in fluid machinery for boosting the pressure of fluid through rotation of an impeller mounted on a rotary shaft, for sucking the fluid into the fluid machinery, having an inlet casing including an internal passage connected to a suction passage provided being orthogonal to the rotary shaft on the upstream side in the stream of the fluid directed to the fluid machinery, the internal passage being formed in a spiral shape so as to induce a swirl stream in the fluid, orthogonal to the rotary shaft, characterized in that a rectifying element capable of distributing flow rates in the swirl stream between the center side and the outer peripheral side of the swirl stream in the internal passage, and also capable of causing fluid flowing from the suction passage into the internal passage to deflect the swirl stream into a swirling direction within the internal passage is provided in the vicinity of an inlet of the internal passage.

Further, according to the present invention, the above-mentioned inlet casing is further provided therein with an auxiliary guide vane capable of, in particular, deflecting the fluid, similar to the above-mentioned guide vane, in parallel with the guide vane.

Further, according to the present invention, in the above-mentioned inlet casing, the guide vane has an arcuated rectifying surface.

Further, according to the present invention, in the above-mentioned inlet casing, the internal passage has a swirling part for inducing a swirl stream in the fluid, and an introduction part for introducing the thus swirl stream induced by the swirling part, into the inlet opening of the fluid machinery, and further, a bell-mouth part is formed on the upstream side of the introduction part, being projected in the axial direction of the rotary shaft.

Further, to the end, according to the present invention, there is provided an inlet casing provided in fluid machinery for boosting up a pressure of fluid through rotation of an impeller mounted on a rotary shaft, for sucking the fluid into the fluid machinery, including an internal passage connected to a suction passage incorporated being orthogonal to the rotary shaft on the upstream side of the fluid machinery in a stream of fluid toward the fluid machinery, the internal passage being formed in a spiral shape so as to induce a swirl stream in the fluid, orthogonal to the rotary shaft of the fluid machinery, characterized in that the internal passage has a swirling part for inducing a swirl stream in the fluid, and an introduction part for introducing the swirl stream induced in the swirling par, into the inlet opening of the fluid machinery, a bell-mouth part is provided at an upstream end of the introduction part, being projected in the axial direction of the rotary shaft, the bell-mouth part having a projecting height which is gradually decreased from the upstream side to the downstream side in the direction of the stream of the fluid in the swirling part, the projecting height of a highest projecting part of the bell-mouth part on the upstream side and that of a lowest projecting part thereof on the downstream side has a relationship of b:c which is set to be in a range from 1:1.1 to 1:1.2, where b is a passage width defined between the lower end of the bell-mouth part and the wall surface of the internal passage in the heighest projecting part and c is a passage width defined by the lower end of the bell-mouth and the wall surface of the internal passage in the lowest projecting part.

Further, to the end, according to the present invention, there is provided a suction passage structure provided in fluid machinery for boosting the pressure of fluid through rotation of an impeller mounted on a rotary shaft, for sucking the fluid into the fluid machinery, including a suction passage arranged being orthogonal to the rotary shaft on an upstream side in a stream of the fluid toward the fluid machinery, and an inlet casing having one end connected to the suction passage and the other end connected to the fluid machinery, the inlet casing having an internal passage which is connected to the suction passage and which is formed in a spiral shape so as to induce a swirl stream in the fluid, being orthogonal to the rotary shaft of the fluid machinery, characterized in that the suction passage and the internal passage are arranged so as to cause their respective center axes to be substantially superposed on a first reference line passing the center line of the rotary shaft and a heightwise center position of the suction passage or the internal passage, and extending along a direction of a stream of the fluid toward the fluid machinery in the suction passage, and the internal passage is provided therein with a guide vane capable of distributing flow rates in the swirl stream of the fluid in the internal passage, between a swirl center side of the swirl stream and a swirl peripheral side thereof, and also capable of deflecting the fluid flowing from the suction passage into the internal passage, into the swirling direction of the swirl stream in the internal passage.

To the end, according to the present invention, a fluid machinery for boosting up a pressure of fluid through rotation of an impeller mounted on the rotary shaft, characterized by the above-mentioned inlet casing or suction passage structure.

The guide vane in the present invention, can exhibit a rectifying action for distributing flow rates in the swirl stream in the internal passage on the upstream side of the internal passage, between the swirl center side and the swirl outer peripheral side, and also exhibits a rectifying action for deflecting the fluid into a swirling direction of the swirl stream in the internal passage on the upstream side of the internal passage. Further, with these rectifying action, a rectified swirl stream can be easily formed in the internal passage. As a result, the suction passage and the internal passage in a symmetric configuration can be used for inducing a swirl stream which is effective for preventing occurrence of a deviation of a cavitations inducing zone, that is, a swirl stream which is rectified and which has higher uniformity, and accordingly, the spiral shape of the internal passage can be relative simple, thereby it is possible to facilitate the design and fabrication thereof.

Further, in the present invention, the projecting height of the bell-mouth part which is provided being projected at the upstream end of the introduction part in the internal passage is gradually decreased from the upstream side to the downstream side, and further, the projecting height of the heighest projecting part of the bell-mouth part on the upstream side and that of the lowest projecting part on the downstream side are formed so as to satisfy a predetermined relationship therebetween. Thus, according to the present invention, it is possible to enhance the uniformity of the stream at the suction opening of the fluid machinery so as to effectively prevent occurrence of a deviation of the cavitations inducing zone.

Other objects, features and advantages of the invention will become apparent from the following description of the embodiments of the invention taken in conjunction with the accompanying drawings.

DETAILED DESCRIPTION OF THE INVENTION

Figure 1:
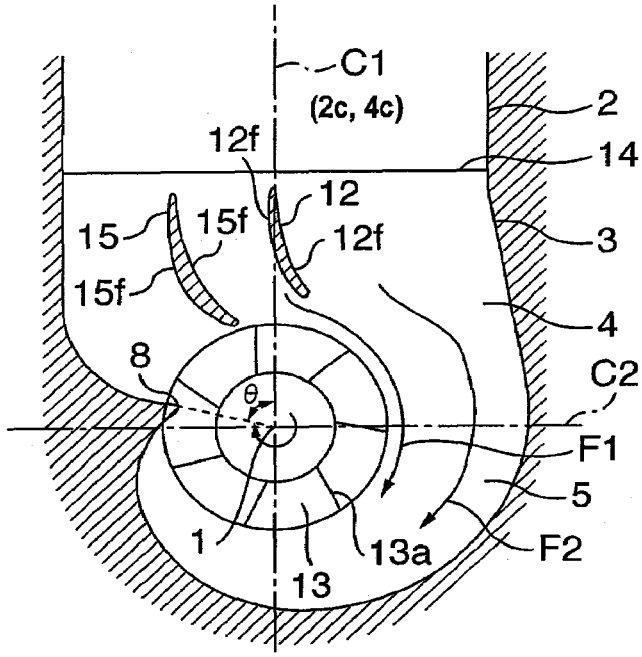
FIG. 1 is a schematic view illustrating a configuration of a suction passage structure in a first embodiment of the present invention, being sectioned in a planar direction.
Figure 2:
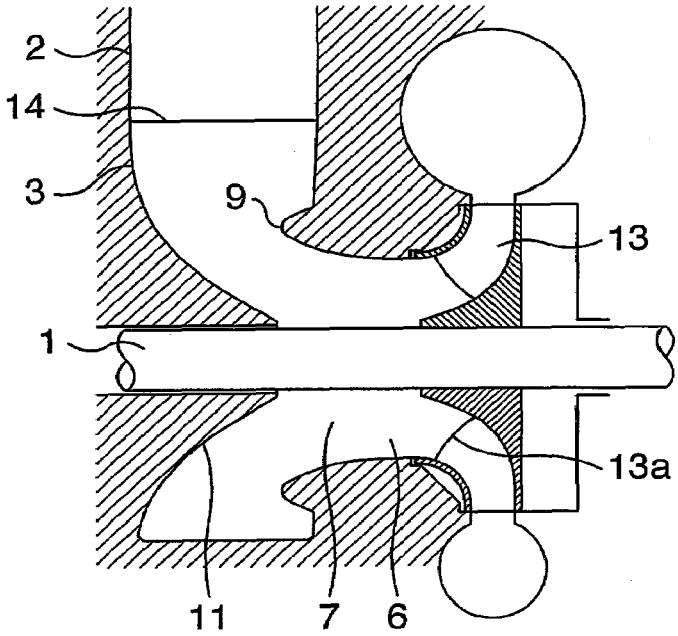
FIG. 2 is a view illustrating the configuration shown in FIG. 1, being sectioned along a first reference line in FIG. 1.

Explanation will be hereinbelow made of preferred embodiment of the present invention. A configuration of a suction passage structure in a first embodiment is schematically shown in FIGS. 1 and 2. FIG. 1 is a view illustrating the suction passage structure, being sectioned in a plan direction, and FIG. 2 is a view, being sectioned along a reference line C1 in FIG. 1. The suction passage structure in this embodiment is composed of a suction passage 2 arranged being orthogonal to a rotary shaft 1 of rotary machinery, on the upstream side in the direction of a stream of the fluid toward the fluid machinery, in combination of an inlet casing 3.

The suction casing 3 is provided therein with an internal passage 4 which is composed of a swirling part 5 in such a spiral shape that a swirl stream orthogonal to the rotary shaft is induced in the fluid introduced through the suction passage 2, that is, a swirl stream rotating around the rotary shaft 1 or an extension of the rotary shaft 1 is induced in the fluid, or such a shape that it is curved with its cross-sectional area being gradually decreased from the upstream side to the downstream side, and an introduction part 7 (FIG. 2) for introducing the fluid swirled in the swirling part 5, into the suction opening 6 of the fluid machinery. Further, the internal passage 4 is provided therein with a baffle part 8 (only shown in FIG. 1), a bell-mouth part 9 (only shown in FIG. 2), a center cone part 11 (only shown in FIG. 2), a guide vane 12 and an auxiliary guide vane 15. It is noted here that the guide vane 12 and the auxiliary guide vane 15 are omitted from FIG. 2.

The baffle part 8 interferes with the fluid flowing downward in the swirling part 5 in the most downstream part of the swirling part so as to have a function capable of adjusting a swirling degree of the fluid. Accordingly, the baffle part 8 is formed in such a way that a part of the wall surface of the internal passage 4 is projected in a wedge-like shape. Further the baffle part 8 is provided in the vicinity of a terminal end of the internal passage 4, that is a terminal end of the swirling part 5, and of four space zones sectioned by a first reference line C1 (which passes through the center line of the rotary shaft 1 and which passes through the heightwise center position of the suction passage 2 or the internal passage 4, being extended along the direction of the stream of fluid directed toward the fluid machinery, in the suction passage 2 or the internal passage 4) and a second reference line C2 (which is orthogonal to the first reference line C1), the one which is located at the most upstream position of the internal passage 4 is arranged therein with the baffle part 8.

Figure 8:
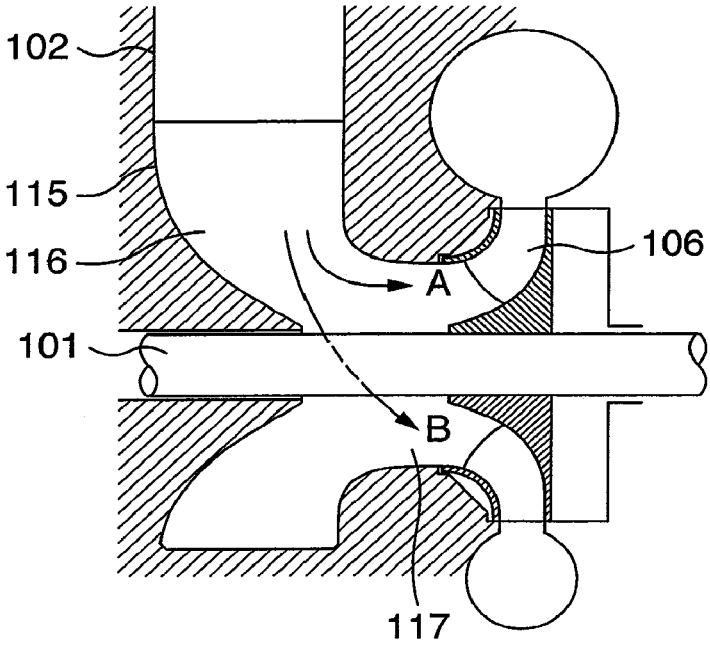
FIG.8 (PRIOR ART)
FIG. 8 is another conventional prewhirl type suction passage structure, being sectioned in a plan direction.

The swirling quantity adjusting function of the above-mentioned baffle part 8 greatly depends upon a position of a distal end thereof. That is, in such a case that the position of the distal end of the baffle part 8 is exhibited by an angle θ between a line horizontally connecting the distal end of the baffle part 8 and the center of the rotary shaft 8 and the second reference line C2, if the angle θ is too small, the quantity of the swirl flow along the entire periphery of the suction opening 6 of the impeller 13 (which has leading edge parts 13*a*) in the fluid machinery is excessive, and on the contrary, if the angle θ is too large, the swirl in the swirling part 5 cannot be sufficiently taken. After the analysis of this phenomenon, it has been found hat the distal end of the baffle part 8 has an angle which is preferably in a range from 45 to 90 deg. The bell-mouth part 9 has a function capable of preventing occurrence of both stream A and stream B shown in FIG. 8, as explained above. Thus, the bell-mouth part 9 is formed so as to have a ring-like shape which surround the rotary axis in a bell-mouth-like manner, and the height thereof in the ring-like shape is set to be uniform in this embodiment. More specifically, the bell-mouth part 9 is formed in such a configuration that a part of the wall surface of the internal passage 4 is projected in a ring-like shape having a uniform height and being directed in the axial direction of the rotary shaft in the most upstream end part of the introduction part 7 in a condition in which it extends along the rotary shaft 1.

The center cone part 11 has a function capable of deflecting the stream in the internal passage 4, into an upward direction toward the introduction part 7, and is formed in such a configuration that the wall surface of the internal passage is projected in a cone-like shape so as to extend along the rotary shaft 1.

The configuration in which the guide vane 12 and the auxiliary plate 15 are provided in the internal passage 4 is one of essential features of the present invention. The guide vane 12 has a function capable of distributing the flow rates of the fluid in the swirl stream of the fluid in the internal passage 4 between the swirl center side stream (indicated by an arrow F1 in FIG. 1) and the swirl outer peripheral side stream (indicated by an arrow F2 in FIG. 1), and also has a function capable inducing a deflection in the swirling direction of the swirl stream in the internal passage 4 in the fluid flowing from the suction passage 2 into the internal passage 4. Thus, the guide vane 12 is formed as a curved shape so as to have arcuated rectifying surfaces 12*f* on both sides thereof, and is arranged so as to divide the internal passage 4 along the direction of the stream of the fluid in the vicinity of the inlet of the internal passage 4 or the suction port 14 of the internal passage 4 which is a connection between the suction passage 2 and the internal passage 4, It is noted here that although the guide vane 12 is arranged so as to substantially bisect the internal passage 4, this arrangement may be changed depending upon a set distributing rate in the above-mentioned distribution of the flow rate.

The auxiliary guide vane 15 has a main function capable of deflecting the fluid, similar to that of the guide vane 12, that is, a function capable of inducting, in the fluid flowing from the suction passage 2 into the internal passage 4, a deflection into the swirling direction of the swirl stream in the internal passage 4. That is, the auxiliary guide vane 15 has a function capable of complementing the fluid deflecting function of the guide vane 12, and accordingly, the deflection of the fluid flowing from the suction passage 2 into the internal passage 4 into the swirl stream can be smoothened further. This auxiliary guide vane 15 is formed into a curved plate, similar to the guide vane 12, so as to have arcuated rectifying surfaces 15*f* on both side of thereof, and in this embodiment shown in this embodiment, it is laid in parallel with the guide vane 12. However, this arrangement and the curved shape can be changed depending upon the positional relationship between the guide vane 12 and the baffle part 8 and a configuration thereof.

One of the essential features of the present invention is such that the suction passage 2 and the internal passage 4 are both have a symmetric configuration. That is, the respective center lines 2*c*, 4*c* of the suction passage 2 and the internal passage 4 are substantially superposed on the first reference line C1. This configuration relates to a configuration for providing the guide vane 12 and the auxiliary plate 15, as explained later.

In the suction passage structure in the first embodiment as stated above, the fluid flowing from the suction passage 2 into the internal passage 4 by way of the suction port 14, is subjected, by the guide vane 12 in the vicinity of the suction port 14, to the rectifying action for distributing flow rates in the swirl stream of the fluid in the internal passage 4 between the swirl center side stream and the swirl outer peripheral side thereof, and by both guide vane 12 and auxiliary guide vane 15, to the rectifying action for deflecting the fluid into the swirling direction of the swirl stream in the swirling part 5 of the internal passage 4. Further, with these rectifying actions, a rectified swirl stream can be easily formed in the swirling part 5. Thereby it is possible to offer the following advantages: the suction passage 2 and the internal passage 4 in a symmetric configuration can be used for obtaining a swirl stream effective for preventing a deviation of a cavitations inducing zone or a rectified and uniform high swirl stream, and accordingly, it is possible to allow the spiral shape of the swirling part 5 to have a relative simple configuration as in the embodiment shown in FIG. 1, thereby the design and the fabrication thereof can be facilitated.

The fluid having been subjected to the rectifying actions by the guide vane 12 and the auxiliary guide vane 15 is turned into a swirl stream so as to flow downward through the swirling part 5, then flows into the introduction part 7 while it is exerted with upward deflection by the center cone part 11, and is finally sucked into the impeller 13 of the flid machinery 13 by way of the suction opening 6. While the fluid flows as stated above, the fluid interferes with the bell-mouth part 9 so as to be exerted thereto with a resistance. The resistance exerted by the bell-mouth 9 constrains occurrence of both stream A and stream B so as to serve to make the stream uniform in the suction opening 6, and in cooperation with the rectifying actions by the guide vane 12 and the auxiliary guide vane 15 as stated above, the uniformity of the stream of the fluid can be further enhanced.

Figure 3:
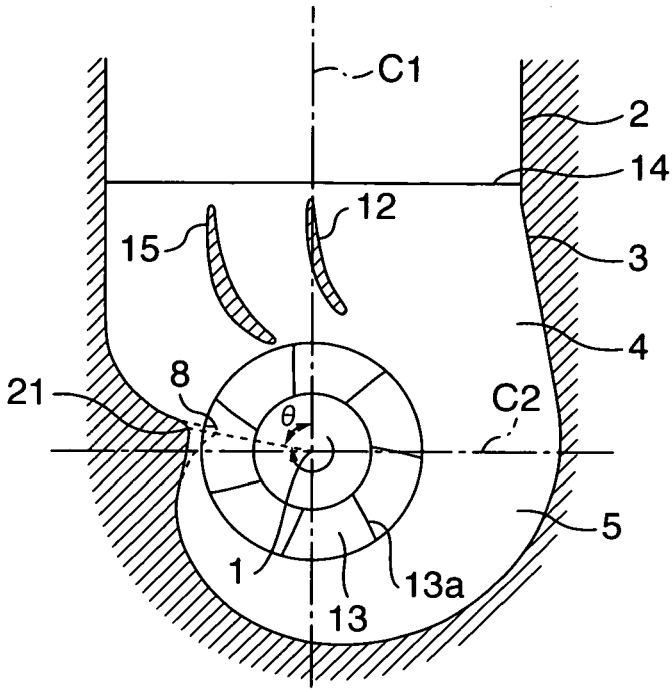
FIG. 3 is a schematic view illustrating a configuration of a suction passage structure in a second embodiment of the present invention, being sectioned in a plan direction.
Figure 4:
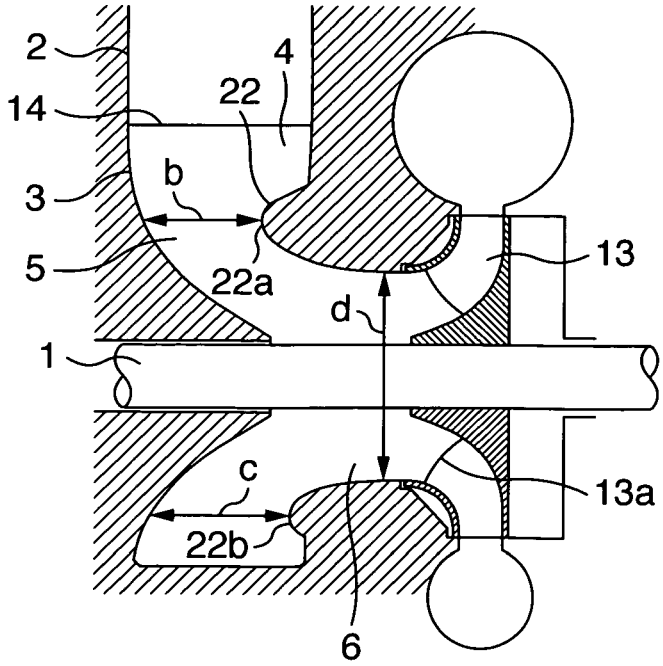
FIG. 4 is a view illustrating the configuration shown in FIG. 3, being section along a first reference line in FIG. 3.

Referring to FIGS. 3 and 4 which shows a configuration of a suction passage structure in a second embodiment of the present invention, the configuration of this embodiment is similar to that of the first embodiment. Explanation will be made of differences of the configuration of this embodiment from that of the first embodiment. It is noted in the figures that like reference numerals are used to like parts to those in the first embodiment.

This embodiment is different from the first embodiment such that a baffle part 21 as a component corresponding to the baffle part 8 shown in FIG. 1 is provided while a bell-mouth part 22 as a component corresponding to the bell-mouth part 9 shown in FIG. 1 is provided.

The baffle part 21 has a projecting height which is lower than that of the baffle part 8. Specifically, the projecting height of the baffle part 8 shown in FIG. 1 is set so that the distal end of the baffle part 8 is overlapped more or less with the contour of the impeller 13, but the baffle part 21 has a distal end part which is slightly spaced from the contour of the impeller 13, more or less. The distal end part of the baffle part 21 which is in a wedge-like shape has an obtuse angle in comparison with that of the baffle part 8. Specifically, the angle of the distal end part of the baffle part 21 is obtained by slightly cutting the distal end part of the baffle pat 8 having an acute angle as indicated by a dotted line in FIG. 3. Such a baffle part 21 can moderate the interference with the fluid in the swirling quantity adjusting function, thereby it is possible to reduce disturbance of the swirl stream caused by the interference. In order to more effectively exhibit the advantages of the baffle part 21, the baffle part 21 is formed into an arcuated shape along the spiral shape of the swirling part 5, and further, the edge of the of the distal end part is preferably formed into an arcuated shape. The baffle part 21 as stated above has a position of a distal end part having an angle which is a range from 45 deg. to 90 deg.

The bell-mouth part 22 has a configuration basically similar that of the bell-mouth part 9, except that it has an asymmetric configuration so as to decrease its projecting height thereof gradually from the upstream side to the downstream side of the swirl stream. With the configuration of this bell-mouth part 22, the fluid can be exerted thereto with a large resistance in the upstream part of the swirl stream by a part 22*a* of the bell-mouth part 22 which has a higher projecting height, thereby it is possible to effectively prevent occurrence of both stream A and stream B shown in FIG. 8. Meanwhile, the fluid is exerted thereto with a relatively small resistance in the downstream part of the swirl stream by a part 22*b* of the bell-mouth part 22 which has a lower projecting height, thereby it is possible to smoothly suck the fluid into the suction opening 6 of the impeller 13.

As stated above, the effect obtained by the bell-mouth part 22 of the asymmetric configuration is dependent upon a ratio of a passage area of the lower part of the bell-mouth part 22 (which is given by the passage width defined between the distal end of the bell-mouth part 22 and the wall surface of the internal passage 4 opposed to the former) to a passage area d of the suction opening 6 of the impeller 13 (which area is actually obtained by subtracting an area occupied by the rotary shaft 1). That is, if the passage area of the lower part of the bell-mouth part 22 is too narrow in comparison with the passage area of the suction opening, specifically if the ratio of the passage area of the lower part of the bell-mouth part 22 which is in particular given by a passage width indicated by b in FIG. 4 to the passage area d of the suction opening, is less than 3, the flow rate becomes too high in the lower part of the bell-mouth part 22 so as to cause a loss to increase, and on the contrary, if the passage area of the lower part of the bell-mouth part 22 is wide in comparison with the passage area d of the suction opening, specifically if the ratio of the passage area of the lower part of the bell mouth part 22 to the passage area d of the suction opening is greater than 4, no effect by the bell-mouth part 22 of the asymmetric configuration can be obtained. Thus, it is preferable to set the projecting height of the bell mouth part 22 (which is an averaged height) so that the ratio between the passage area of the lower part of the bell-mouth part 22 with respect to the passage area d of the suction opening falls in a range from 1:3 to 1:4.

Further, the effect of the bell-mouth part 22 of the asymmetric configuration is dependent upon the ratio between the height of the part 22*a* having the highest projecting height and that of the part 22*b* having the lowest projecting height, in other words, the ratio between the passage width b defined between the distal end of the part 22*a* having the highest projecting height and the wall surface of the internal passage 4 opposed to thereto and the passage width c defined between the distal end of the part 22*b* having the lowest projecting height and the wall surface of the internal passage 4 opposed thereto. That is, if the ratio of the passage width c of the lower part of the bell-mouth part 22 in the part having the lowest projecting height to the passage width b of the lower part of the bell-mouth part 22 in the part having the highest projecting part is too large, that is, it is greater than 1.2, the resistance in the part 22*a* having the highest projecting height becomes excessively large while the inflow of the fluid into the suction opening 6 in the part 22*b* having the lowest projecting height becomes relatively large. As a result, the uniformity along the entire periphery of the suction opening 6 is deteriorated. The ratio between the passage width c of the lower part of bell-mouth part to the passage width b of the lower part of the bell-mouth part is too small, that is, specifically, it is smaller than 1.1, the resistance in the part 22*a* having the highest projecting height is too small while the inflow of the fluid into the suction opening 6 in the part having the part having the lowest projecting height becomes relatively small. As a result, the uniformity around the entire periphery of the suction opening 6 is similarly deteriorated. Thus, the projecting height of the bell-mouth part 22 is set so that the ratio of the passage width c of the lower part of the bell-mouth part to the passage width b of the lower part of the bell-mouth part falls in a range from 1:1.1 to 1:1.2. It is noted that the passage width b and the passage width c give passage areas of the associated parts of the lower part of the bell-mouth part. In other words, the passage width b and the passage width c can correspond to the passage areas of the associated parts of the lower part of the bell-mouth part.

It is noted here that although explanation has been made of the embodiments in which the single side suction type spiral pump is used as an example, and in which the rotary shaft is extended into the inlet casing for the purpose of convenient explanation, the present invention should not be limited to these embodiments, but the present invention can be applied in any or various fluid machinery which requires uniformity at the suction opening of the impeller.

Figure 5:
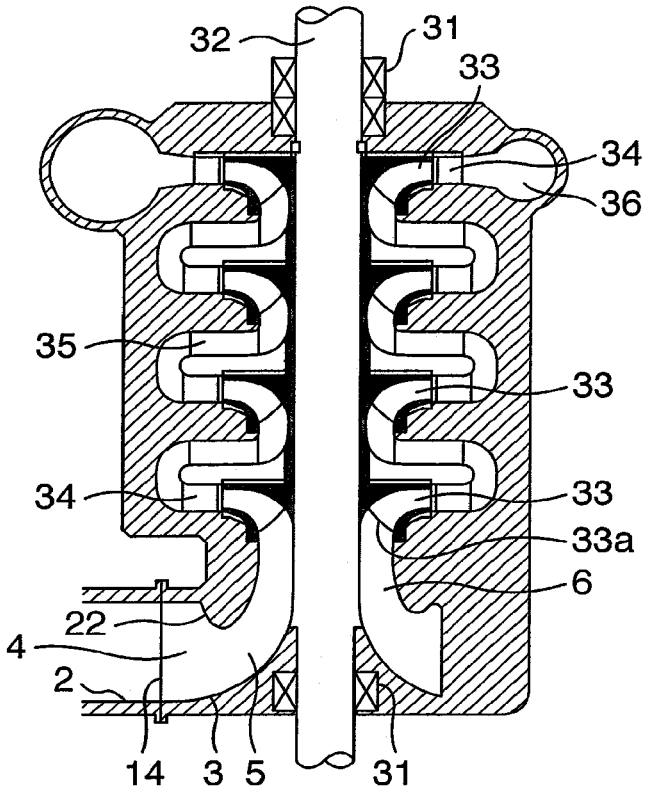
FIG. 5 is a view illustrating a configuration of an essential part of a vertical single-side suction type multistage pump.
Figure 6:
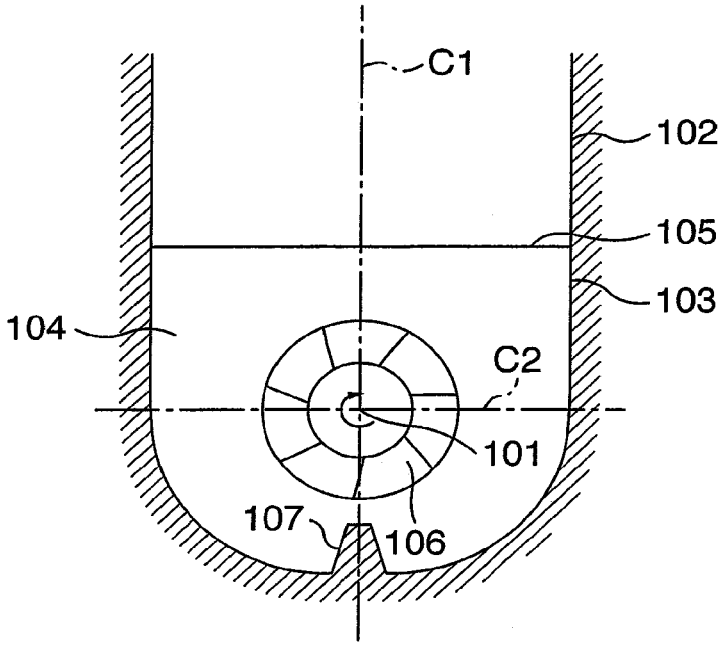
FIG.6 (PRIOR ART)
FIG. 6 is a schematic view illustrating a configuration of a conventional nonprewhirl type suction passage structure, being sectioned in a plan direction.
Figure 7:
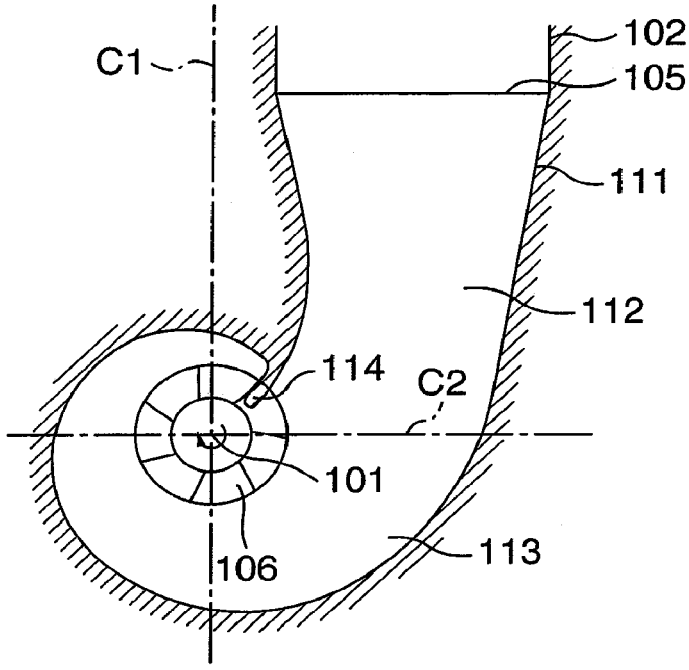
FIG.7 (PRIOR ART)
FIG. 7 is a conventional prewhirl type suction passage structure, being sectioned in a plan direction.

Next, explanation will be hereinbelow made of a third embodiment of the present invention. In this embodiment, the configuration of the suction passage structure in the second embodiment is applied in a vertical single side suction type multi-stage pump. Referring to FIG. 5 which shows a configuration of an essential part of the vertical single side suction type multi-stage pump, the vertical single side suction type multi-stage pump incorporates a rotary shaft 32 which is journalled at opposite ends thereof by radial bearings 31, the pressure of fluid is boosted up through rotation of impellers 33 (which has leading edges 33*a*) at multi-stages (four stages in the figure) mounted on the rotary shaft 32. Specifically, the fluid whose pressure has been boosted up by one of the impellers 33 passes through a diffuser 34, radially outward from the rotary shaft 32 side, and then passes through a return 35 where it is deflected into a stream in a radially inward direction so as to be led into the impeller 33 at the next stage. With the repetitions of the above-mentioned steps, the fluid is boosted up by the impellers 33. High pressure fluid boosted up by the impeller 33 at the final stage, is led through the diffuser 34 and is recovered in a discharge casing 36 from which it is led to a discharge opening (which is not shown).

The vertical single side suction type multi-stage pump is integrally incorporated thereto with the inlet casing 3 in the suction passage structure in the second embodiment, and the suction passage 2 is connected to the inlet casing 3 through the intermediary of the suction port 14. The configuration of the suction passage structure composed of the suction passage 2 and the internal passage 4 have been already explained in the second embodiment, and accordingly, the explanation thereto will be omitted in this embodiment.

According to the present invention, the suction passage structure constrains occurrence of a deviation of a cavitations inducing zone as the suction of fluid in fluid machinery, and further a configuration of an internal passage in a prewhirl type suction casing can be simplified. The invention as detailed hereinabove can be widely used in the technical field of the fluid machinery.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An inlet casing provided for sucking fluid into a sectional opening of fluid machinery for boosting up the fluid through rotation of an impeller mounted on a rotary shaft, comprising a suction passage arranged being orthogonal to the rotary shaft on an upstream side in a stream of the fluid directed toward the fluid machinery, and an internal passage connected to the suction passage, the internal passage being formed in a spiral shape so as to induce a swirl stream orthogonal to the rotary shaft of the fluid machinery, wherein a guide vane is provided in the vicinity of an inlet port of the internal passage to distribute flow rates in the swirl stream of the fluid in the internal passage between a swirl center side and a swirl outer peripheral side of the swirl stream, and to cause the fluid flowing from the suction passage into the internal passage to deflect into a swirling direction of the swirl stream in the internal passage.

2. An inlet casing as set forth in claim 1, wherein an auxiliary guide vane mainly having a function capable of causing the fluid to deflect, having a configuration similar to the guide vane and arranged parallel to the latter is provided to cause.

3. An inlet casing as set forth in claim 2, wherein the guide vane has an arcuated rectifying surface.

4. An inlet casing as set forth in claim 1, wherein the internal passage includes a swirling part for inducing the swirl stream in the fluid, and an introduction part for introducing the swirl stream of the fluid induced by the swirling part, into the suction opening of the fluid machinery, the introduction part being provided with a bell-mouth part which is projected in the axial direction of the rotary shaft at the upstream side end of the introduction part.

5. An inlet casing provided for sucking fluid into a section opening of fluid machinery for boosting up the fluid through rotation of an impeller mounted on a rotary shaft, comprising a suction passage arranged being orthogonal to the rotary shaft on an upstream side in a stream of the fluid directed toward the fluid machinery, and an internal passage connected to the suction passage, the internal passage is formed in a spiral shape so as to induce a swirl stream orthogonal to the rotary shaft of the fluid machinery, wherein the internal passage includes a swirling part for inducing the swirl stream in the fluid, and an introduction part for introducing the swirl stream of the fluid induced by the swirling part, into the suction opening of the fluid machinery, the introduction part is provided with a bell-mouth portion which is projected in the axial direction of the rotary shaft at the upstream side end of the introduction part, the bell-mouth portion having a projecting height which is gradually decreased from the upstream side to the downstream side of a stream of the fluid in the swirling part, and a highest projecting height on the upstream side in the projecting height of the bell-mouth portion and a lowest projecting height on the downstream side in the protecting height of the bell-mouth portion have therebetween a relationship so that a ratio b c falls in a range from 1: 1.1 to 1: 1.2 where b is a passage width defined between a lower end of the bell-mouth portion and a wall surface of the internal passage in the part having the highest projecting height and c is a passage width defined between the lower end of the bell-mouth portion and the wall surface of the internal passage in the part having the lowest projecting height.

6. A fluid passage structure adapted to suck fluid into fluid machinery for boosting up the fluid through rotation of an impeller mounted on a rotary shaft, comprising a suction passage arranged being orthogonal to the rotary shaft on an upstream side in a stream of fluid directed toward the fluid machinery and an inlet casing having one end connected to the suction passage and the other end connected to the fluid machinery, the inlet casing having an internal passage connected to the suction passage, and the internal passage being formed in a spiral shape for inducing a swirl flow orthogonal to the rotary shaft of the fluid machinery, in the fluid, wherein the suction passage and the internal passage are provided so that their center lines are superposed on a first reference line which passes through the center line of the rotary shaft, passing through a heightwise center position of the suction passage or the internal passage, and is extended along the direction of the stream of the fluid directed to the fluid machinery in the suction passage, and a guide vane having a function capable of distributing flow rates in the swirl stream of the fluid in the internal passage between a swirl center side and a swirl outer peripheral side of the swirl stream, and having a function capable of causing the fluid flowing from the suction passage into the internal passage to deflect into a swirling direction of the swirl stream in the internal passage is provided in the vicinity of an inlet port of the internal passage.

* * * * *